US008672584B2

(12) United States Patent
Koerner et al.

(10) Patent No.: US 8,672,584 B2
(45) Date of Patent: Mar. 18, 2014

(54) DRAINAGE BEADS

(75) Inventors: Dennis Wayne Koerner, Memphis, TN (US); Carl David Ring, Memphis, TN (US); Jonathan Browning Jackson, Collierville, TN (US)

(73) Assignee: RAPAC, Oakland, TN (US)

( * ) Notice: Subject to any disclaimer, the term of this patent is extended or adjusted under 35 U.S.C. 154(b) by 192 days.

(21) Appl. No.: 13/220,134

(22) Filed: Aug. 29, 2011

(65) Prior Publication Data

US 2012/0288331 A1 Nov. 15, 2012

Related U.S. Application Data

(60) Provisional application No. 61/486,020, filed on May 13, 2011.

(51) Int. Cl.
*E02B 11/00* (2006.01)

(52) U.S. Cl.
USPC ..... 405/50; 206/584

(58) Field of Classification Search
USPC ..... 405/43, 45, 50, 36; 206/584
See application file for complete search history.

(56) References Cited

U.S. PATENT DOCUMENTS

| | | | | |
|---|---|---|---|---|
| 3,104,085 | A | | 9/1963 | Skladany |
| 3,167,600 | A | | 1/1965 | Worman |
| 3,188,264 | A | | 6/1965 | Holden |
| 3,233,414 | A | | 2/1966 | Hansen, Jr. et al. |
| 3,334,798 | A | | 8/1967 | Pezely, Jr. et al. |
| 3,679,531 | A | | 7/1972 | Wienand et al. |
| 4,077,154 | A | | 3/1978 | Muller |
| 4,166,875 | A | | 9/1979 | Bussey, Jr. |
| D255,220 | S | | 6/1980 | Bussey, Jr. |
| D255,661 | S | * | 7/1980 | Atkins ..... 206/584 |
| D255,875 | S | * | 7/1980 | Atkins ..... D9/456 |
| 4,215,166 | A | | 7/1980 | Bussey, Jr. |
| 4,234,657 | A | | 11/1980 | Bussey, Jr. |
| D258,267 | S | | 2/1981 | Atkins |
| 4,261,940 | A | | 4/1981 | Bussey, Jr. |
| 4,269,895 | A | | 5/1981 | Borchert et al. |
| 4,411,555 | A | | 10/1983 | Minvielle et al. |
| 4,474,505 | A | | 10/1984 | Minvielle et al. |
| 4,500,586 | A | | 2/1985 | Bussey, Jr. |
| 4,514,453 | A | | 4/1985 | Bussey |
| 4,606,965 | A | | 8/1986 | Bussey |
| 4,983,068 | A | | 1/1991 | Kozak et al. |
| 4,990,116 | A | | 2/1991 | Chen |

(Continued)

FOREIGN PATENT DOCUMENTS

| | | |
|---|---|---|
| DE | 2755833 | 7/1978 |
| FR | 2374478 | 7/1978 |

OTHER PUBLICATIONS

Babu, et al., "Effect of polystyrene aggregate size on strength and moisture migration characteristics of lightweight concrete," *Cement & Concrete Composites*, 28:520-527 (2006).

*Primary Examiner* — Frederick L Lagman
(74) *Attorney, Agent, or Firm* — Kilpatrick Townsend & Stockton LLP

(57) ABSTRACT

Polystyrene drainage beads having optimized shapes to provide increased specific gravity and void volume at a given bulk density. Expanded forms of such drainage beads may be used as a geosynthetic aggregate in pre-assembled drainage units. Such pre-assembled drainage units may be used as foundation drains, septic drainage fields, or for other applications.

27 Claims, 14 Drawing Sheets

(56) References Cited

U.S. PATENT DOCUMENTS

| | | | | |
|---|---|---|---|---|
| 5,015,123 | A | 5/1991 | Houck et al. | |
| 5,028,470 | A | 7/1991 | Reichenecker | |
| D319,392 | S | 8/1991 | Ring | |
| 5,051,028 | A | 9/1991 | Houck et al. | |
| 5,061,218 | A | 10/1991 | Garage et al. | |
| 5,069,647 | A | 12/1991 | Zuviria | |
| 5,151,312 | A | 9/1992 | Boeri | |
| 5,154,543 | A | 10/1992 | Houck et al. | |
| 5,160,785 | A | 11/1992 | Davidson, Jr. | |
| 5,188,880 | A | 2/1993 | Tether | |
| 5,215,490 | A | 6/1993 | Szoradi | |
| 5,254,389 | A | 10/1993 | Tether | |
| 5,267,863 | A | 12/1993 | Simmons, Jr. | |
| 5,378,357 | A | 1/1995 | Houck et al. | |
| 5,468,556 | A | 11/1995 | Fuss et al. | |
| 5,482,491 | A | 1/1996 | Kichijyo | |
| 5,515,975 | A | 5/1996 | Jarvis et al. | |
| 5,535,499 | A | 7/1996 | Houck et al. | |
| 5,595,458 | A | 1/1997 | Grabhorn | |
| 5,639,364 | A | 6/1997 | Houck et al. | |
| 5,657,527 | A | 8/1997 | Houck et al. | |
| 5,713,696 | A * | 2/1998 | Horvath et al. | 405/45 |
| 5,770,138 | A | 6/1998 | Yoder | |
| 5,788,423 | A | 8/1998 | Perkins | |
| 5,871,384 | A | 2/1999 | Kichijo | |
| 5,928,052 | A | 7/1999 | Buscher | |
| 5,946,994 | A | 9/1999 | Tether et al. | |
| 6,053,661 | A | 4/2000 | Lewis | |
| 6,062,772 | A | 5/2000 | Perkins | |
| 6,109,835 | A | 8/2000 | Grabhorn | |
| 6,221,445 | B1 | 4/2001 | Jones | |
| 6,467,996 | B1 | 10/2002 | Garner | |
| 6,818,274 | B1 | 11/2004 | Buck et al. | |
| 6,857,818 | B2 * | 2/2005 | Bussey et al. | 405/38 |
| 7,014,390 | B1 | 3/2006 | Morris | |
| 7,857,547 | B1 | 12/2010 | Summers et al. | |
| 2004/0183221 | A1 | 9/2004 | Bussey et al. | |
| 2007/0227977 | A1 | 10/2007 | Fadhel et al. | |
| 2009/0242833 | A1 | 10/2009 | Chen et al. | |

* cited by examiner

DRAINAGE BEADS

RELATED APPLICATIONS

This patent application claims the benefit of the filing date of U.S. Application No. 61/486,020, filed May 13, 2011 for a "Drain Bead," the entire contents of which are incorporated by this reference.

RELATED FIELDS

Pre-assembled drainage units utilizing aggregates of drainage beads.

BACKGROUND

In the past, traditional drainage systems (such as for foundation drains, septic drainage fields, and other applications) have employed gravel aggregate and, optionally, a perforated pipe or pipes surrounded by the gravel aggregate. The gravel provides structure and void volume to the drainage system.

More recently, pre-assembled drainage units utilizing a geosynthetic aggregate surrounded by a perforated sleeve have been utilized instead of gravel aggregate. U.S. Pat. No. 5,015,123 shows examples of pre-assembled drainage units. One type described includes a length of perforated distribution pipe surrounded by a volume of loose lightweight pieces of plastic aggregate bounded by a perforated sleeve. Another type does not include the pipe, just the plastic aggregate bounded by the perforated sleeve.

U.S. Pat. No. 6,467,996 describes improved geosynthetic drainage beads for use as an aggregate in pre-assembled drainage units. The drainage bead described in this patent includes a central portion with several legs and ribs extending therefrom, the legs defining channels therebetween. The legs and ribs of the drainage bead help to maintain void volume in the drainage unit. This patent emphasizes that the legs should be wider than the channels, to prevent the beads from interlocking with one another. Additionally, this patent emphasizes that the central portion of the bead should be relatively thick, in order to maximize strength.

As with the gravel aggregate, the geosynthetic aggregates described in these two patents provide structure and void volume for the drainage systems.

Current practices limit the ability of the manufacturer to maximize the specific gravity and void volume of the drainage beads at a specified bulk density. Specific gravity may be used as one indicator of the compressive strength of the drainage beads (e.g. resistance to the compressive forces typically encountered in drainage systems), whereas void volume may be used as one indicator of performance of the drainage system (i.e. fluid holding capacity). Current practices use bulk density as the primary mechanism for controlling specific gravity. Raising bulk density, however, typically requires increasing manufacturing cost, since higher bulk density means a greater amount of raw materials will be required to produce the drainage unit.

SUMMARY

Applicants have developed enhanced drainage bead geometries that provide for increased specific gravity and void volume of the bead at a specified bulk density. Applicants have also discovered that this increased performance can be provided without sacrificing structural strength of the drainage bead. Examples of such optimized drainage bead geometries are described below. These optimized geometries facilitate the production of pre-assembled drainage units having relatively high compressive strength and fluid holding capacity at a relatively low cost.

DETAILED DESCRIPTION OF THE DRAWINGS

Figure 1:
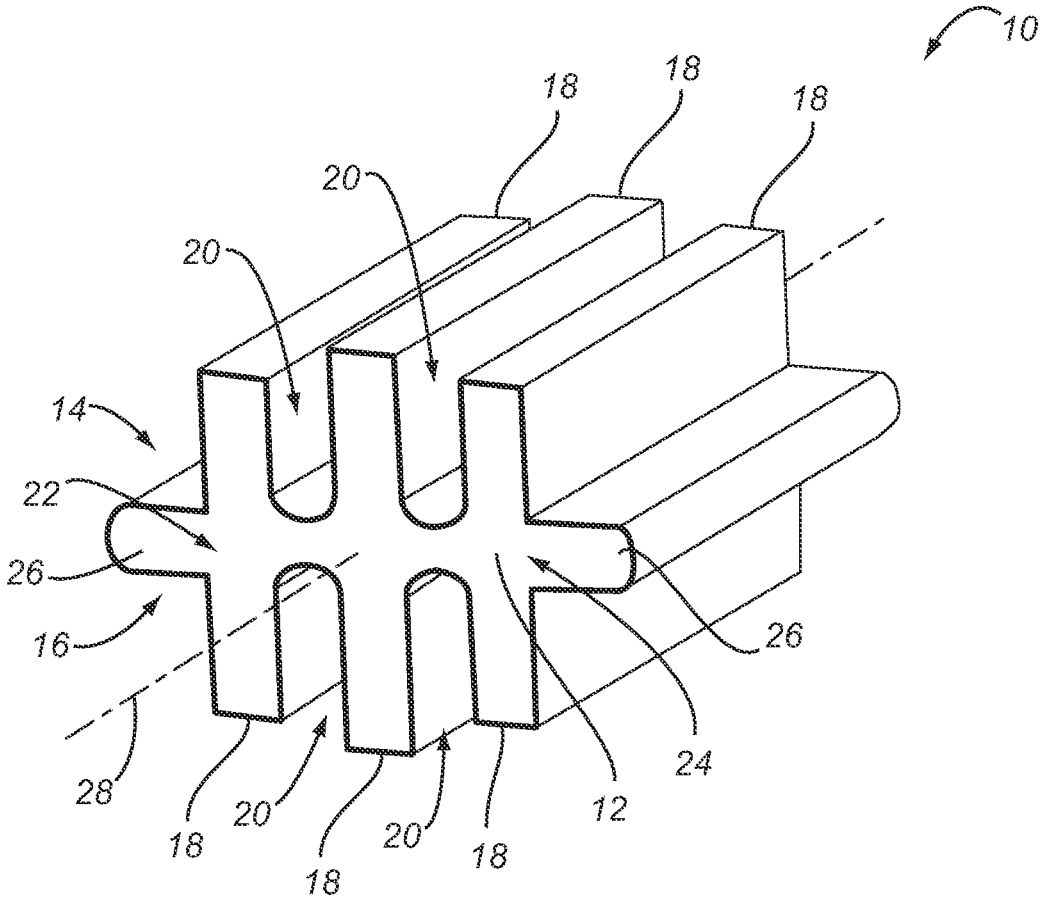
FIG. 1 shows one non-limiting example of an expanded polystyrene drainage bead.

FIGS. 1-10 show one non-limiting example of a drainage bead 10. The drainage bead 10 includes a central spine 12 having a first side 14 and a second side 16 opposite the first side 14. Several legs 18 (in this embodiment, six) extend from the first and second sides 14 and 16. In this embodiment, the central leg 18 is longer than the other legs 18. The legs 18 define channels 20 between them. The central spine 12 also includes a third side 22 and fourth side 24, with an arm 26 extending from each side 22 and 24. As shown in FIG. 1, the bottoms of channels 20 and outer portions of the arms 26 are radiused. Although not shown in FIG. 1, outer portions of the legs 18 and other portions of drainage bead 10 may also be radiused.

The drainage bead 10 of FIG. 1 extends along an axis 28 and defines a uniform, solid cross-sectional shape along the axis 28. In some embodiments, the drainage bead is extruded and the axis 28 reflects an axis along which the drainage bead was extruded. In some embodiments, the drainage bead is expanded polystyrene, and, thus, while having a uniform, solid cross-sectional shape along its axis 28, it may include small pockets formed during the expansion process.

As discussed above, drainage beads of the present invention feature optimized geometries that promote relatively high specific gravities and void volumes at a specified bulk density. Non-limiting examples of these optimized geometries are discussed below in context of the drainage bead 10 of FIGS. 1-10.

FIGS. 2-10 show a cross-section of the drainage bead 10 of FIG. 1 perpendicular to the bead's axis 28, and illustrates various dimensions of that drainage bead 10. As mentioned above, in some embodiments, the drainage bead may be expanded polystyrene. One of skill in the art will appreciate that in such embodiments, the expansion process will not result in completely identical beads, and that some amount of variation will be present from bead to bead. Accordingly, the dimensions discussed below reflect average values of an aggregate of beads, and not necessarily the exact dimensions of a single bead.

Figure 2:
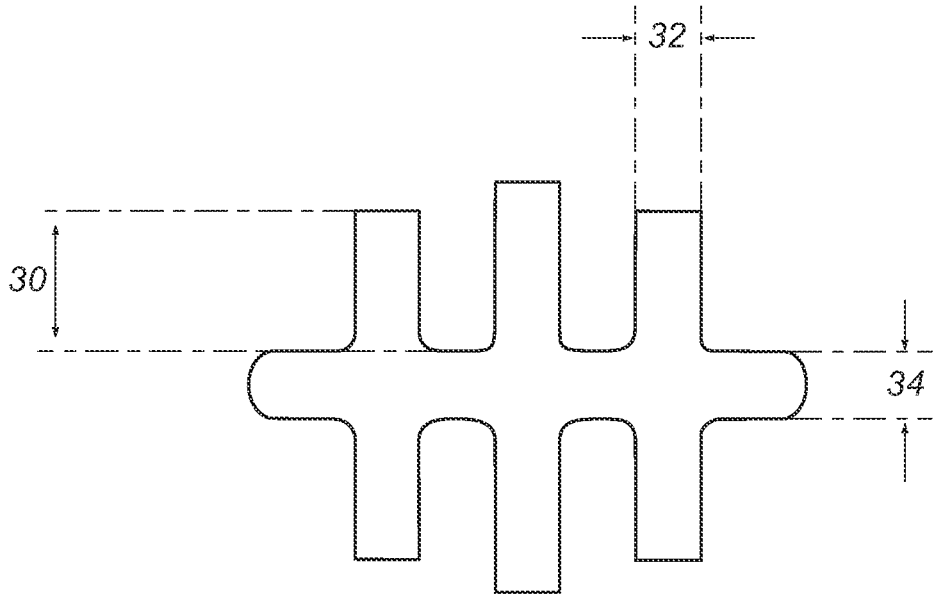
FIGS. 2-10 show a cross-section of the drainage bead of FIG. 1.

FIG. 2 illustrates three dimensions of drainage bead 10: leg length 30, leg width 32, and arm width 34. The leg length 30 shown in FIG. 2 may be measured from a point level with the bottom of a channel 20 to the outermost portion of the leg 18. In the embodiment of FIGS. 1-10, leg length 30 is 0.2873 inches. Leg width 32 may be measured at a midpoint along the length of leg 18. In the embodiment of FIGS. 1-10, leg width 32 is 0.1853 inches. It can be appreciated from FIG. 2 that the leg width 32 is narrower than the width of the channels 20 of the drainage bead 10 (in this particular embodiment, the channel width is 0.2911 inches). Arm width 34 may also be measured at a midpoint along the length of the arm 26. In the embodiment of FIGS. 1-10, arm width 34 is 0.1696.

Figure 3:
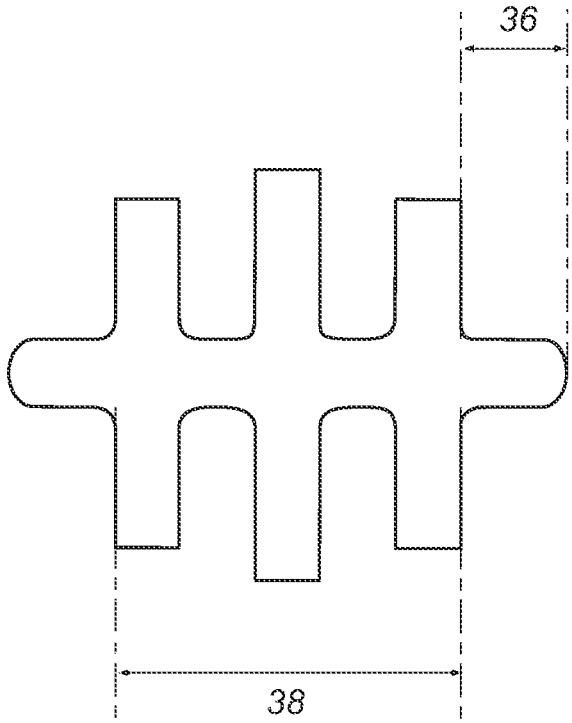

FIG. 3 illustrates two other dimensions of drainage bead 10: arm length 36 and spine length 38. The arm length 36 shown in FIG. 3 may be measured from the outermost portion of the arm to the straight portion of the side of outer leg 18 (i.e. arm length 30 may include the radiused base portion of the arm 26 to the extent the arm 26 includes a radiused base). In the embodiment of FIGS. 1-10, arm length 36 is 0.2282 inches. Spine length 38 may be measured from a point level with an outer side of an outer leg 18 to a point level with an outer side of another outer leg 18. In the embodiment of FIGS. 1-10, spine length 38 is 0.8726 inches.

Figure 4:
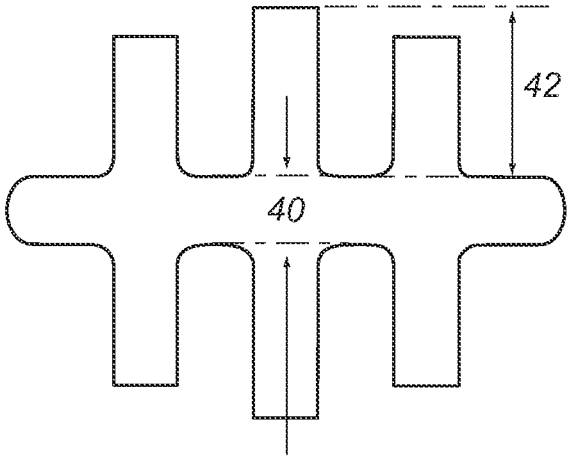

FIG. 4 illustrates two further dimensions of drainage bead 10: spine thickness 40 and length of center leg 42. The spine thickness 40 shown in FIG. 4 may be measured from the bottom of a channel 20 on the first side 14 of the central spine 12 to the bottom of a channel 20 on the second side 16. In the embodiment of FIGS. 1-10, spine thickness 40 is 0.2283 inches. Length of center leg 42 may be measured similarly to the other leg lengths 30 (i.e. as shown in FIG. 2). In the embodiment of FIGS. 1-10, length of center leg 42 is 0.3654 inches.

Figure 5:
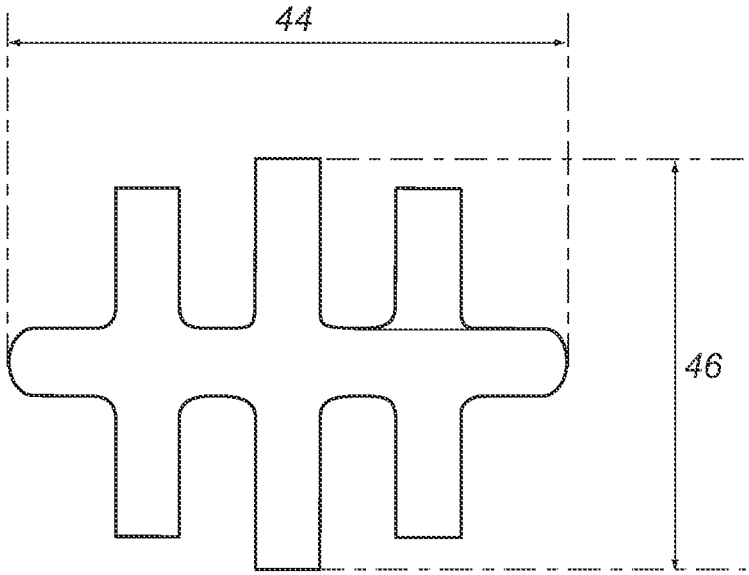

FIG. 5 illustrates two further dimensions of drainage bead 10: overall width 44 and overall height 46. The overall width 44 shown in FIG. 5 may be measured from the outermost portion of one arm 26 to the outermost portion of the other arm 26. In the embodiment of FIGS. 1-10, overall width 44 is 1.3034 inches. Overall height 46 may be measured from the outermost portion of the longest leg 18 (e.g. the center leg) on one side of the drainage bead 10 to the outermost portion of the longest leg (e.g. the center leg) on the other side. In the embodiment of FIGS. 1-10, overall height 46 is 0.8743 inches.

Figure 6:
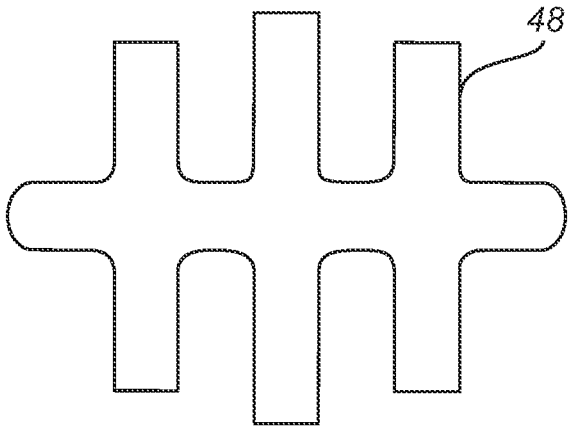

FIG. 6 illustrates an outer perimeter measurement 48 of drainage bead 10, which, in this particular embodiment, is 5.3784 inches.

Figure 7:
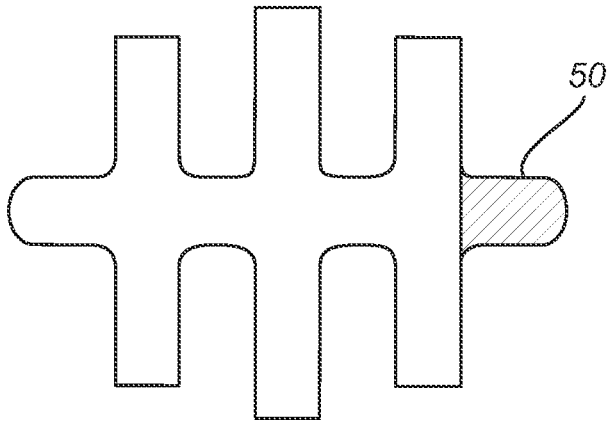
Figure 8:
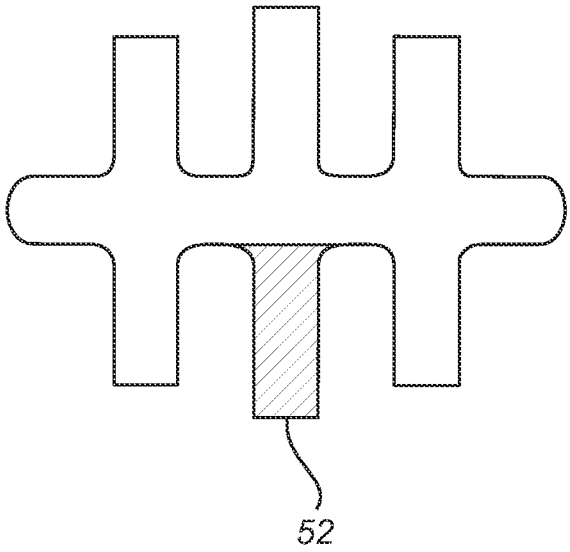
Figure 9:
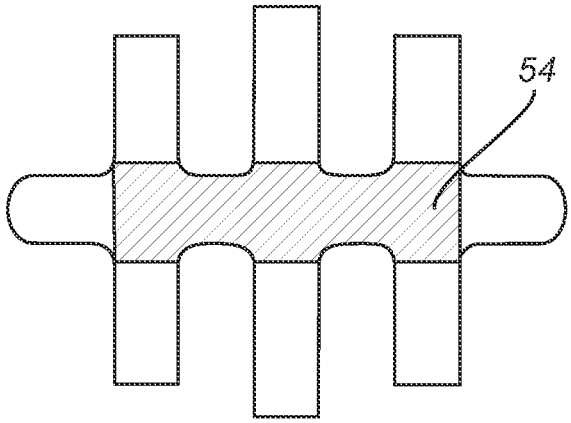
Figure 10:
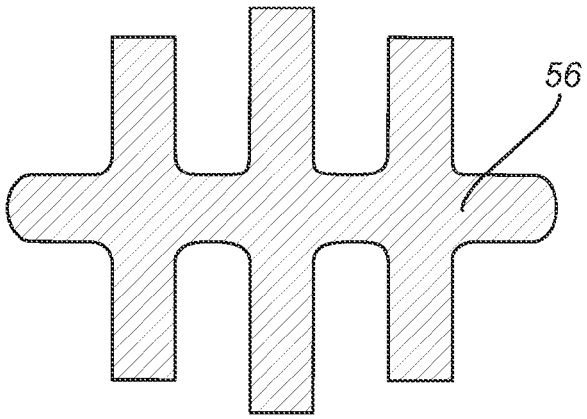

FIGS. 7-10 illustrate various area measurements of drainage bead 10. FIG. 7 illustrates an arm area 50, which, in this particular embodiment, is 0.0352 square inches. FIG. 8 illustrates a center leg area 52, which, in this particular embodiment, is 0.0561 square inches. FIG. 9 illustrates a central spine area 54, which, in this particular embodiment, is 0.2044 square inches. FIG. 10 illustrates a total area 56 of the drainage bead cross section, which, in this particular embodiment, is 0.5532 square inches.

The following table illustrates certain average dimensions, geometries, ratios and other characteristics of drainage bead 10 and various prior art drainage beads:

| Bead | Perimeter | Total Area | Perimeter/ Total Area | Spine Width | Leg Length | Leg Length/ Spine Width | Leg Width | Leg Length/ Leg Width | Specific Gravity |
|---|---|---|---|---|---|---|---|---|---|
| Drainage Bead 10 | 5.37 in | 0.55 $in^2$ | 9.71 | 0.22 in | 0.29 in | 1.32 | 0.18 in | 1.61 | 1.20 |
| Prior Art Bead 1 | 4.85 in | 0.67 $in^2$ | 7.24 | 0.33 in | 0.24 in | 0.73 | 0.18 in | 1.33 | 0.9 |
| Prior Art Bead 2 | 3.66 in | 0.52 $in^2$ | 7.04 | 0.35 in | 0.18 in | 0.51 | 0.19 in | 0.95 | 0.9 |
| Prior Art Bead 3 | 4.13 in | 0.54 $in^2$ | 7.65 | 0.32 in | 0.22 in | 0.69 | 0.20 in | 1.10 | 0.9 |

One of skill in the art will recognize that the present invention is not limited to drainage beads having any particular dimension or geometry, and that drainage beads having different dimensions and geometries are possible and within the scope of the present invention. For instance, without limitation, in some embodiments the drainage bead may have dimensions such that the ratio of perimeter to total area may be another number that is greater than eight (or in some embodiments, 7.7), such that the ratio of leg length to spine width may be another number that is greater than 0.8 (or in some embodiments, 0.75), or such that the ratio of leg length to leg width may be another number that is greater than 1.4 (or in some embodiments, 1.35). In these or other embodiments, other dimensions and ratios may also be used to characterize the present invention. One of skill in the art will also recognize that the dimensions of a drainage bead, or average dimensions of a drainage bead, can be determined using techniques other than those specifically identified above and illustrated in FIGS. 2-10. One of skill in the art will also recognize that the dimensions discussed above, such as leg length, leg width, etc., do not have to be uniform for each bead. For instance, in some embodiments, leg width or length may vary among different legs on the bead.

In some embodiments, the drainage bead may have dimensions such that the ratio of the arm length (e.g. arm length 36 shown in FIG. 3) to the leg width (e.g. leg width 32 shown in FIG. 2) is greater than 25%.

Figure 11:
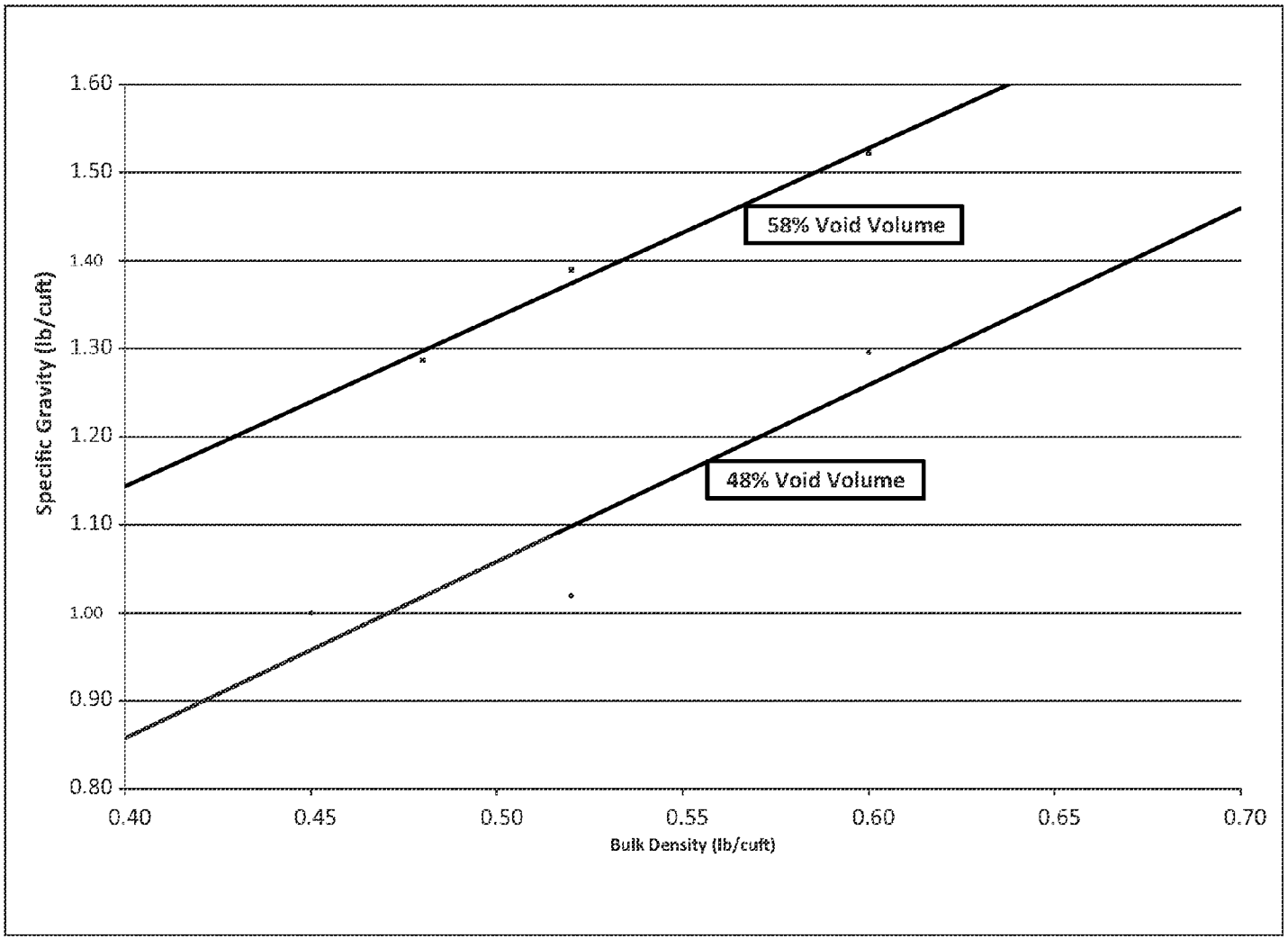
FIG. 11 is a chart comparing the drainage bead of FIG. 1 to a known drainage bead.

FIG. 11 is a chart illustrating specific gravity and bulk density for embodiments of drainage beads of the present invention (top line) compared to specific gravity and bulk density for certain prior art drainage beads (bottom line). As shown in FIG. 11, drainage beads in accordance with the present invention feature a higher specific gravity at a given bulk density than these prior art drainage beads. As shown in FIG. 11, drainage beads of the present invention also feature a higher percentage void volume than these prior art beads. Those of skill in the art will appreciate that specific gravity and bulk density may be measured using a variety of appropriate methodologies. As one non-limiting example, standard test methods established by ASTM International of West Conshohocken, Pa. (including ASTM D792 and C29/29M) may be employed to measure specific gravity and bulk density. In some embodiments, the ratio of specific gravity to bulk density may be greater than 2.3, 2.4 or 2.5.

As mentioned above, in at least some embodiments, drainage beads of the present invention may be formed through an extrusion process. In some embodiments, polystyrene pellets (e.g. recycled polystyrene pellets) are introduced into an extrusion apparatus in which they are melted and mixed with a blowing agent such as pentane gas. The melted polystyrene is extruded through a die, passed through a cooling bath, and is subsequently cut into un-expanded beads. The beads may be packaged and shipped in an un-expanded form.

Figure 12:
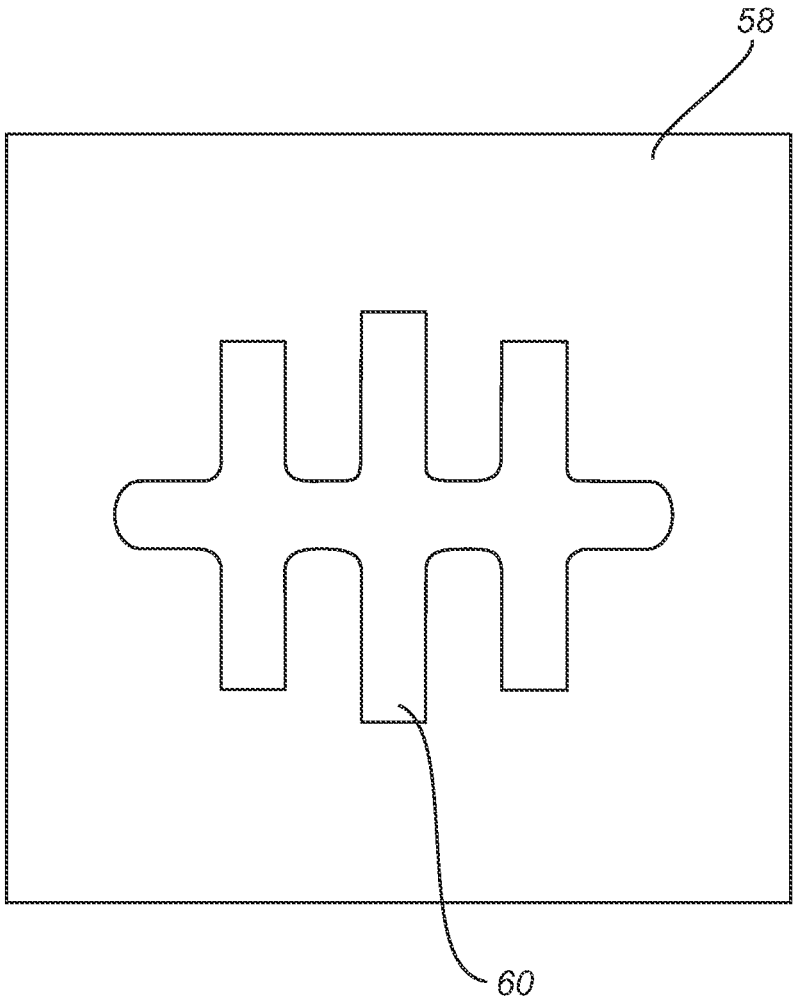
FIG. 12 schematically shows an extrusion die for forming an unexpanded drainage bead.

FIG. 12 schematically shows one non-limiting example of a die 58 including a die aperture 60 that may be used in the extrusion process. Although FIG. 12 only shows one die aperture 60, one of skill in the art will recognize that such a die may include multiple die apertures.

Figure 13:
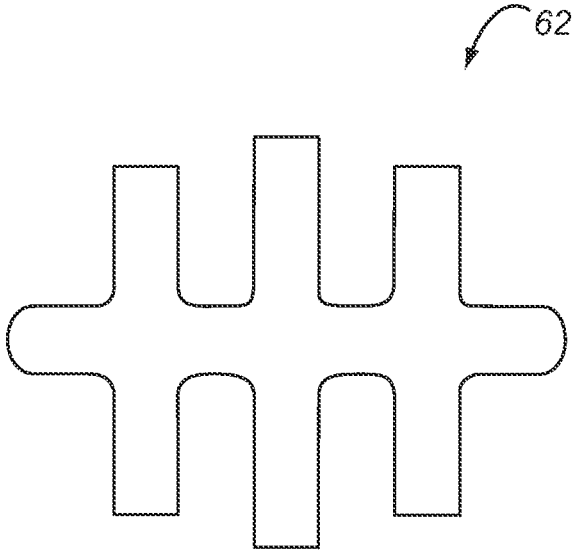
FIG. 13 shows an unexpanded drainage bead.

The die aperture 60 of FIG. 12 has a shape and dimensions suitable for extruding the un-expanded drainage bead 62 shown in cross-section in FIG. 13. Once expanded using an appropriate expansion process, un-expanded drainage bead will have the shape and dimensions of expanded drainage bead 10 shown in FIGS. 1-10. Using similar measurement techniques to those described above, un-expanded drainage bead 62 may be characterized by the following measurements and dimensions: a leg width of 0.0352 inches, an arm length of 0.0584 inches, an arm width of 0.0352 inches, an overall width of 0.3025 inches, an overall height of 0.2213 inches at the center legs and 0.1896 inches at the outer legs, and a channel width of 0.0400 inches. One of skill in the art will recognize that the present invention is not limited to these particular dimensions or geometries.

In some embodiments, un-expanded drainage beads may be expanded into expanded drainage beads using a multi-pass expansion process in which the beads are subjected to high temperature steam. In one non-limiting example, the drainage beads are subjected to a first pass in which the beads are subjected to steam at a suitable temperature for a suitable time in order to increase the bulk density of the beads from approximately 22 to 25 pounds per cubic foot to approximately 0.9 pounds per cubic foot and a second pass in which the beads are subjected to steam at a suitable temperature for a suitable time in order to increase the bulk density of the partially expanded beads to approximately 0.5 pounds per cubic foot.

Figure 14:
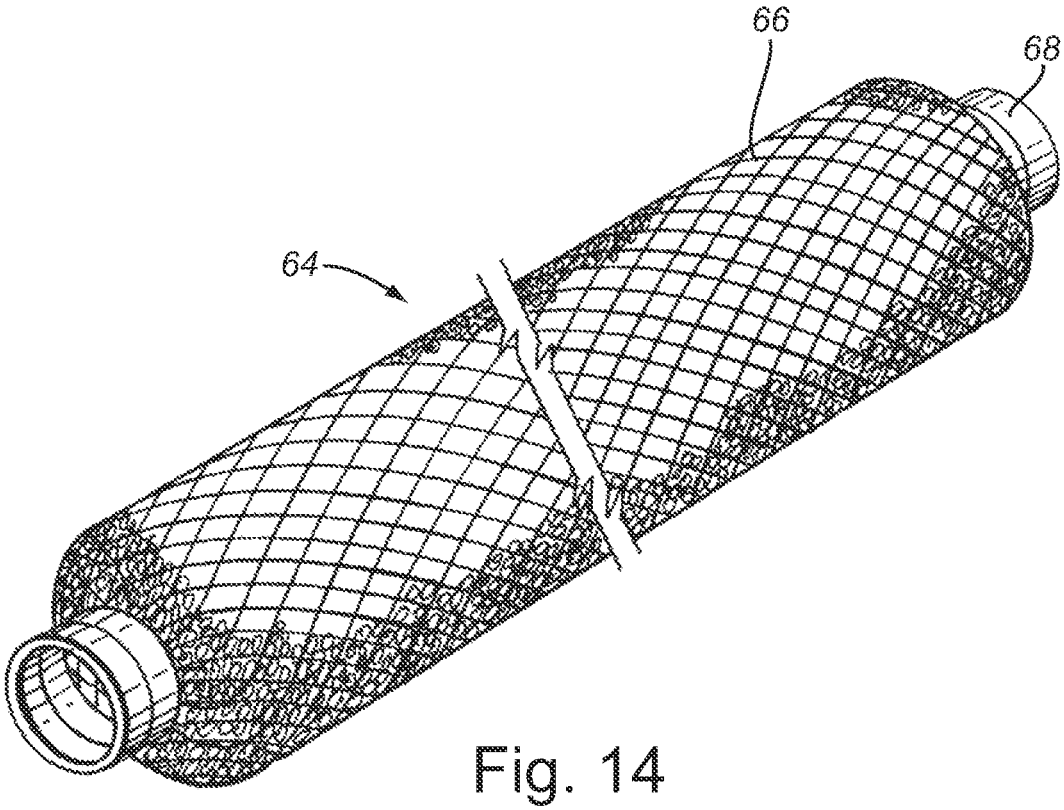
FIG. 14 shows one non-limiting example of a pre-assembled drainage unit.
Figure 15:
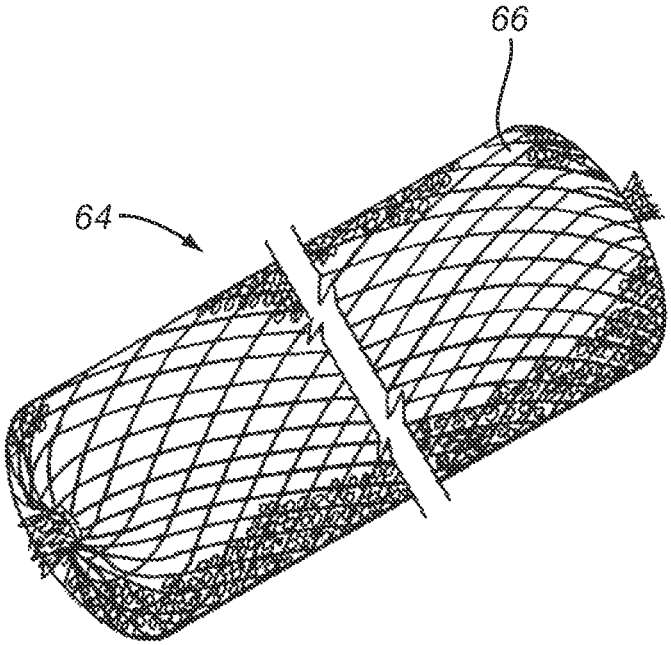
FIG. 15 shows another non-limiting example of a pre-assembled drainage unit.

In some embodiments, once expanded, an aggregate of expanded drainage beads may be put into a pre-assembled drainage unit, such as the pre-assembled drainage unit 64 illustrated in FIG. 14. In this embodiment, the pre-assembled drainage unit 64 includes a perforated sleeve 66 enclosing the drainage beads 10, as well as a pipe 68 extending between the ends of the perforated sleeve 66. Such a pipe is not necessary in all embodiments, however, as illustrated by the pre-assembled drainage unit 64 shown in FIG. 15.

One of skill in the art will recognized that changes may be made to the above-described non-limiting embodiments without departing from the scope or spirit of the present invention.

We claim:

1. An aggregate comprising a plurality of polystyrene drainage beads, wherein at least some of the drainage beads comprise:

(a) a central spine including a first side and a second side opposite the first side;

(b) at least three first legs extending from the first side of the central spine and defining a plurality of first channels between the first legs, wherein the first channels are wider than the first legs;

(c) at least three second legs extending from the second side of the central spine and defining a plurality of second channels between the second legs; and (d) a uniform, solid cross-sectional shape along an axis of extension.

2. The aggregate of drainage beads of claim 1, wherein the plurality of polystyrene drainage beads are expanded polystyrene drainage beads.

3. The aggregate of drainage beads of claim 2, wherein the cross-sectional shape is perpendicular to the axis of extension, and defines a cross-sectional area and a cross-sectional perimeter, wherein the ratio of the cross-sectional perimeter to the cross-sectional area is greater than 7.7.

4. The aggregate of drainage beads of claim 2, wherein the central spine defines a spine width extending between the plurality of first and second legs and wherein the plurality of first and second legs each define a leg length extending away from the central spine; wherein the ratio of the leg length to the spine width is greater than 0.75.

5. The aggregate of drainage beads of claim 4, wherein the plurality of first and second legs each define a leg width; wherein the ratio of the leg length to the leg width is greater than 1.35.

6. The aggregate of drainage beads of claim 4, wherein the plurality of first legs includes a central leg that is longer than the other first legs.

7. The aggregate of drainage beads of claim 2, further comprising a perforated sleeve enclosing the plurality of drainage beads.

8. The aggregate of drainage beads of claim 7, further comprising a pipe extending from a first end of the perforated sleeve to a second end of the perforated sleeve.

9. The aggregate of drainage beads of claim 1, wherein the plurality of polystyrene drainage beads are un-expanded polystyrene drainage beads.

10. The aggregate of drainage beads of claim 9, wherein the cross-sectional shape is perpendicular to the axis of extension, and defines a cross-sectional area and a cross-sectional perimeter, wherein the ratio of the cross-sectional perimeter to the cross-sectional area is greater than 53.

11. The aggregate of drainage beads of claim 9, wherein the central spine defines a spine width extending between the plurality of first and second legs and wherein the plurality of first and second legs each define a leg length extending away from the central spine; wherein the ratio of the leg length to spine width is greater than 2.

12. The aggregate of drainage beads of claim 1, wherein at least some of the drainage beads further comprise a first arm extending from a third side of the central spine and a second arm extending from a fourth side of the central spine.

13. The aggregate of drainage beads of claim 12, wherein the first and second arms extend in substantially perpendicular directions to the first and second legs.

14. The aggregate of drainage beads of claim 1, wherein the central spine and first and second legs are substantially planar.

15. The aggregate of drainage beads of claim 1, wherein the second channels are wider than the second legs.

16. An aggregate comprising a plurality of expanded polystyrene drainage beads, wherein at least some of the drainage beads comprise:

(a) a central spine including a first side and a second side opposite the first side;

(b) at least three first legs extending from the first side of the central spine and defining a plurality of first channels between the first legs;

(c) at least three second legs extending from the second side of the central spine and defining a plurality of second channels between the second legs; and (d) a uniform, solid cross-sectional shape along an axis of extension, wherein the cross-sectional shape is perpendicular to the axis of extension and defines a cross-sectional area and a cross-sectional perimeter, wherein the ratio of the cross-sectional perimeter to the cross-sectional area is greater than 8.

17. The aggregate of drainage beads of claim 16, wherein the first channels are wider than the first legs and the second channels are wider than the second legs.

18. The aggregate of drainage beads of claim 16, wherein the central spine defines a spine width extending between the at least three first and second legs; wherein the at least three first and second legs each define a leg length extending away from the central spine; and wherein the ratio of the leg length to spine width is greater than 0.8.

19. The aggregate of drainage beads of claim 18, wherein the at least three first and second legs each define a leg width; wherein the ratio of the leg length to leg width is greater than 1.4.

20. The aggregate of drainage beads of claim 19, wherein the at least three first legs include a central leg that is longer than the other first legs.

21. The aggregate of drainage beads of claim 16, further comprising a perforated sleeve enclosing the plurality of drainage beads.

22. The aggregate of drainage beads of claim 21, further comprising a pipe extending from a first end of the perforated sleeve to a second end of the perforated sleeve.

23. An aggregate comprising a plurality of expanded polystyrene drainage beads, wherein at least some of the drainage beads comprise:

(a) a central spine including a first side and a second side opposite the first side;

(b) at least three first legs extending from the first side of the central spine and defining a plurality of first channels between the first legs, wherein the first channels are wider than the first legs;

(c) at least three second legs extending from the second side of the central spine and defining a plurality of second channels between the second legs;

(d) a first arm extending from a third side of the central spine and a second arm extending from a fourth side of the central spine, wherein the first and second arms extend in substantially perpendicular directions to the first and second legs; and (e) a uniform, solid cross-sectional shape along an axis of extension, wherein the cross-sectional shape is perpendicular to the axis of extension and defines a cross-sectional area and a cross-sectional perimeter, wherein the ratio of the cross-sectional perimeter to the cross-sectional area is greater than 8; wherein a perforated sleeve encloses the plurality of drainage beads.

24. The aggregate of drainage beads of claim 23, wherein the second channels are wider than the second legs.

25. An aggregate comprising a plurality of expanded polystyrene drainage beads, wherein at least some of the drainage beads comprise:

(a) a central spine including a first side and a second side opposite the first side;

(b) at least three first legs extending from the first side of the central spine and defining a plurality of first channels between the first legs;

(c) at least three second legs extending from the second side of the central spine and defining a plurality of second channels between the second legs; and (d) a uniform, solid cross-sectional shape along an axis of extension; wherein the central spine defines a spine width extending between the plurality of first and second legs; wherein the plurality of first and second legs each define a leg length extending away from the central spine; and wherein the ratio of the leg length to spine width is greater than 0.8.

26. An aggregate comprising a plurality of expanded polystyrene drainage beads, wherein at least some of the drainage beads comprise:

(a) a central spine including a first side and a second side opposite the first side;

(b) at least three first legs extending from the first side of the central spine and defining a plurality of first channels between the first legs;

(c) at least three second legs extending from the second side of the central spine and defining a plurality of second channels between the second legs; and (d) a uniform, solid cross-sectional shape along an axis of extension; wherein the plurality of first and second legs each define a leg length extending away from the central spine, and wherein the plurality of first and second legs each define a leg width; wherein the ratio of the leg length to leg width is greater than 1.4.

27. An aggregate comprising a plurality of expanded polystyrene drainage beads, wherein at least some of the drainage beads comprise:

(a) a central spine including a first side and a second side opposite the first side;

(b) at least three first legs extending from the first side of the central spine and defining a plurality of first channels between the first legs;

(c) at least three second legs extending from the second side of the central spine and defining a plurality of second channels between the second legs;

(d) a first arm extending from a third side of the central spine and a second arm extending from a fourth side of the central spine, wherein the first and second arms extend in substantially perpendicular directions to the first and second legs; and (e) a uniform, solid cross-sectional shape along an axis of extension; wherein the first and second arms each define arm length, wherein the plurality of first and second legs each define a leg width, and wherein the ratio of arm length to leg width is greater than 0.25.

* * * * *